US008999040B2

(12) United States Patent
Johansson

(10) Patent No.: US 8,999,040 B2
(45) Date of Patent: Apr. 7, 2015

(54) METHOD AND SYSTEM FOR DISCHARGING AN ELECTROSTATIC PRECIPITATOR

(75) Inventor: Anders Johansson, Hovmantorp (SE)

(73) Assignee: ALSTOM Technology Ltd, Baden (CH)

( * ) Notice: Subject to any disclaimer, the term of this patent is extended or adjusted under 35 U.S.C. 154(b) by 482 days.

(21) Appl. No.: 13/437,100

(22) Filed: Apr. 2, 2012

(65) Prior Publication Data

US 2012/0255438 A1 Oct. 11, 2012

(30) Foreign Application Priority Data

Apr. 5, 2011 (CH) ..... 608/11

(51) Int. Cl.
*B03C 3/76* (2006.01)
*B03C 3/74* (2006.01)
*B03C 3/68* (2006.01)

(52) U.S. Cl.
CPC .. *B03C 3/68* (2013.01); *B03C 3/763* (2013.01)

(58) Field of Classification Search
CPC ..... B03C 3/49; B03C 3/66; B03C 3/68; B03C 3/70; B03C 3/74; B03C 3/76; B03C 9/00; G05F 1/10; G05F 1/66; G05F 1/70; G05F 1/625; G05F 5/00
USPC ..... 95/74, 76; 96/18, 20–24, 30–35, 80
See application file for complete search history.

(56) References Cited

U.S. PATENT DOCUMENTS 3,648,437 A * 3/1972 Bridges ..... 96/20
4,152,124 A * 5/1979 Davis ..... 96/21
4,284,417 A * 8/1981 Reese et al. ..... 95/3
4,290,003 A * 9/1981 Lanese ..... 323/241
4,502,872 A 3/1985 Ivester et al.
5,920,474 A * 7/1999 Johnson et al. ..... 363/126
6,336,961 B1 1/2002 Terai et al.
6,937,455 B2 * 8/2005 Krichtafovitch et al. ..... 361/230
7,001,447 B1 * 2/2006 Altman et al. ..... 95/74
7,081,152 B2 * 7/2006 Altman et al. ..... 95/5
7,413,593 B2 * 8/2008 Altman et al. ..... 95/2
7,594,958 B2 * 9/2009 Krichtafovitch et al. ..... 96/18
7,704,302 B2 * 4/2010 Abdelkrim et al. ..... 96/20
8,007,566 B2 * 8/2011 Abdelkrim et al. ..... 95/5
8,268,040 B2 * 9/2012 Boyden et al. ..... 95/5
8,328,902 B2 * 12/2012 Boyden et al. ..... 95/5
8,623,116 B2 * 1/2014 Karlsson ..... 95/4

(Continued)

FOREIGN PATENT DOCUMENTS

CN 101152637 A 4/2008
GB 2447125 A 9/2008

(Continued)

OTHER PUBLICATIONS

European Patent Office, Search Report in Swiss Patent Application No. 60 82 011 (May 25, 2011).

*Primary Examiner* — Duane Smith
*Assistant Examiner* — Sonji Turner
(74) *Attorney, Agent, or Firm* — Rita D. Vacca

(57) ABSTRACT

A method for cleansing an electrostatic precipitator having a collecting electrode and an emission electrode includes applying a voltage between the collecting electrode and the emission electrode and reducing the applied voltage from a first voltage to a second voltage upon an occurrence of a spark between the collecting electrode and the emission electrode.

18 Claims, 1 Drawing Sheet

(56) References Cited

U.S. PATENT DOCUMENTS

2008/0264249 A1* 10/2008 Truce ..... 95/6
2011/0017067 A1 1/2011 Lemont et al.

FOREIGN PATENT DOCUMENTS

JP 2000 117146 4/2000
JP 2002 143720 5/2002

* cited by examiner

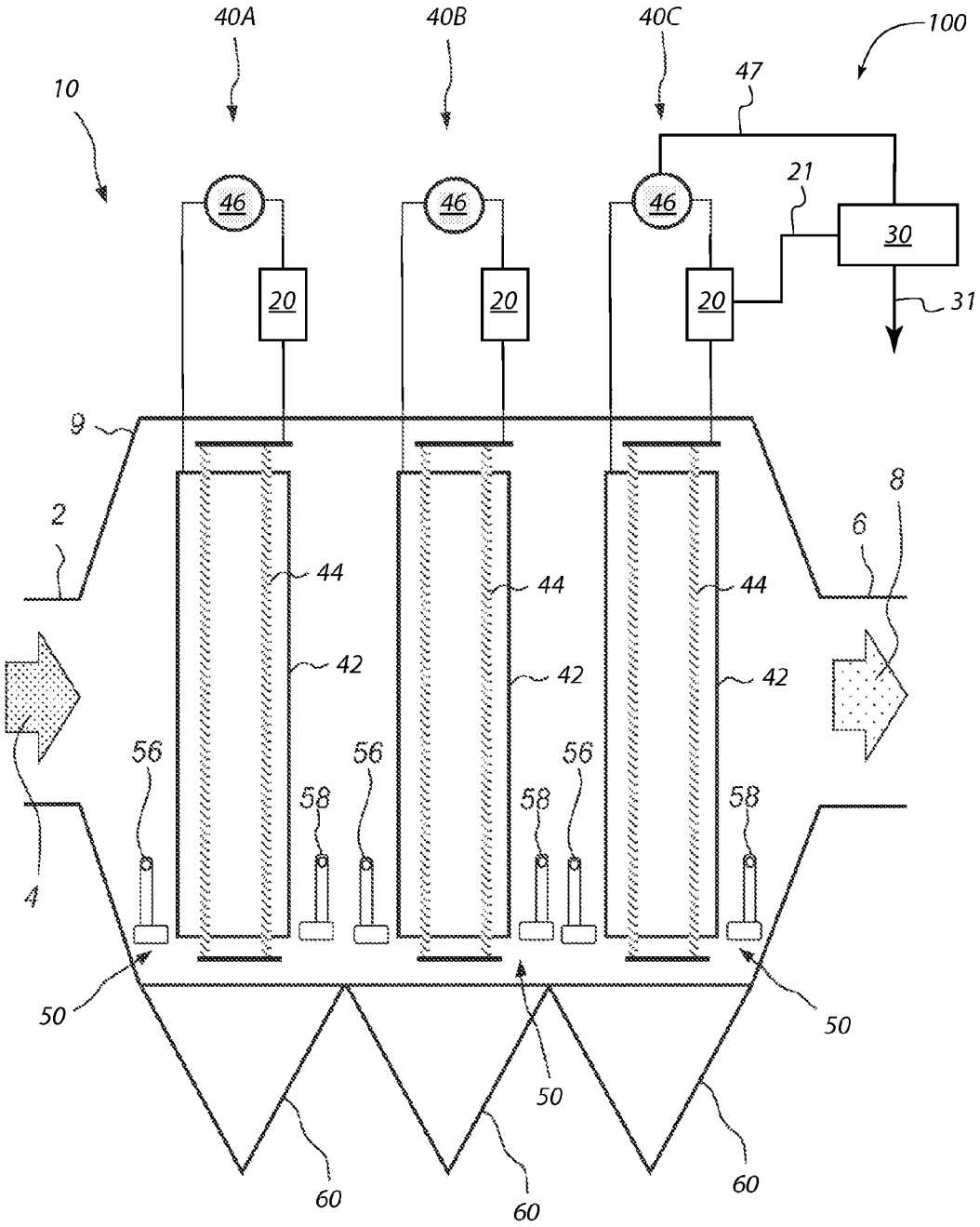
40A
40B
40C
100
10
47
21
46
46
46
30
20
20
20
31
9
2
8
6
44
44
44
42
42
42
56
56
56
58
58
58
4
50
50
50
60
60
60

METHOD AND SYSTEM FOR DISCHARGING AN ELECTROSTATIC PRECIPITATOR

CROSS-REFERENCE TO PRIOR APPLICATION

Priority is claimed to Swiss Patent Application No. CH 00608/11, filed on Apr. 5, 2011, the entire disclosure of which is hereby incorporated by reference herein.

FIELD

The present invention relates to a method for cleansing an electrostatic precipitator as well as to a system for cleansing an electrostatic precipitator.

BACKGROUND

Electrostatic precipitators are used for removing particulate matter from a gaseous stream. For example, electrostatic precipitators are commonly found in industrial facilities where the combustion of coal, oil, industrial waste, domestic waste, peat, biomass, etc. produces flue gases that contain particulate matter, e.g. fly ash.

Electrostatic precipitators operate by creating an electrostatic field between at least two electrodes. A first of these electrodes typically has a plate-like shape and is connected to a power supply so as to carry a positive charge. Such an electrode is commonly designated as a collecting electrode or collecting plate. A second of these electrodes is typically embodied in the form of a wire and is connected to said power supply so as to carry a negative charge. Such an electrode is commonly designated as an emission electrode or discharge electrode. Particulate matter in a gaseous stream passing by the second electrode is likewise given a negative charge and is thus attracted to and retained by the positive charge on the collecting electrode. Further information regarding the general construction and operation of an electrostatic precipitator as can be used in conjunction with the teachings of the present disclosure can be found e.g. in U.S. Pat. No. 4,502,872, the entire disclosure of which is hereby incorporated by reference.

Over time, particulate matter accumulates on the collecting electrode, thus diminishing the efficiency with which the electrostatic precipitator can remove particulate matter from the gaseous stream. To combat this problem, it is well known to mechanically hammer against the collecting electrode, a technique known as rapping. This rapping of the collecting electrode causes particulate matter to fall from the collecting electrode into a collecting bin provided therebelow, thus at least partially cleansing the collecting electrode of particulate matter.

Prior art techniques for cleansing the collecting electrode of accumulated particulate matter do not fulfill the expectations of the market as regards, inter alia, the speed and thoroughness of cleansing

SUMMARY

In an embodiment, the present invention provides a method for cleansing an electrostatic precipitator having a collecting electrode and an emission electrode. The method includes reducing a voltage applied between the collecting electrode and the emission electrode from a first voltage to a second voltage upon an occurrence of a spark between the collecting electrode and the emission electrode. In another embodiment, the present invention provides a device for performing the method.

BRIEF DESCRIPTION OF THE DRAWING

The present invention will be described in even greater detail below based on the exemplary FIGURE. The invention is not limited to the exemplary embodiment. Features described and/or represented in the FIGURE can be used alone or combined in embodiments of the present invention. Other features and advantages of various embodiments of the present invention will become apparent by reading the following detailed description with reference to the attached drawing which illustrates the following:

FIG. 1 shows a schematic view of an exemplary embodiment of a system in accordance with the present invention.

It is an aspect of the present invention to address the aforementioned shortcomings of the prior art. In an embodiment, the present invention provides a method for cleansing an electrostatic precipitator having a collecting electrode and an emission electrode, the method comprising reducing a voltage applied between the collecting electrode and the emission electrode upon occurrence of a spark between the collecting electrode and the emission electrode.

The teachings of the present disclosure stem, inter alia, from recognition of the underlying problem that the particulate matter accumulated on the collecting electrode has an inherent electric resistivity that inhibits swift discharge of the particulate matter, even if the collecting electrode is electrically connected to a source of opposite charge, e.g. grounded. In other words, the accumulated particulate matter itself acts as a large capacitor vis-à-vis the emission electrode, thus retaining the electric field between the collecting electrode and the emission electrode for quite some time, even if no voltage is applied between the collecting electrode and the emission electrode. This electric field can be strong enough to prevent a dislodging of the accumulated particulate matter from the collecting electrode even when the collecting electrode is strongly vibrated by mechanical rapping.

In an embodiment, the present invention addresses this underlying problem by reducing, e.g. actively reducing, the voltage applied between the collecting electrode and the emission electrode at an opportune moment, namely upon occurrence of a spark between the collecting electrode and the emission electrode.

A spark between the collecting electrode and the emission electrode intrinsically equates to a significant transfer of charge between the collecting electrode and the emission electrode. The disclosed reduction of an applied voltage upon occurrence of a spark actively reinforces the breakdown of the electric field between the collecting electrode and the emission electrode that is onset by the spark. As a result, the inherent charge in the accumulated particulate matter can be disbanded more swiftly, and cleansing of the collecting electrode can be effected more swiftly and thoroughly, even using conventional cleansing techniques such as rapping.

The method can comprise reducing the voltage applied between the collecting electrode and the emission electrode to a zero or substantially zero voltage. Similarly, the method can comprise reducing the voltage applied between the collecting electrode and the emission electrode from a first voltage to a second voltage, where the first voltage is a voltage applied between the collecting electrode and the emission electrode immediately prior to the occurrence of the spark, and the second voltage is a significantly lower voltage, e.g. a voltage less than one tenth of the first voltage, less than one hundredth of the first voltage. Moreover, the second voltage can be of polarity opposite to that of the first voltage, i.e. the second voltage can be a voltage of less than zero.

As touched upon above, applying a reduced voltage between the collecting electrode and the emission electrode promotes breakdown of the electric field between the collecting electrode and the emission electrode, thus allowing any residual charge in the accumulated particulate matter to be disbanded. This discharging of the accumulated particulate matter, together with the breakdown of the electric field, reduces the electrostatic attraction between the particulate matter and the collecting electrode and thus facilitates cleansing of the collecting electrode.

The second voltage should be dimensioned such that the attraction between the particulate matter resulting from electrostatic interaction between an expected residual charge in the particulate matter and the electric field between the collecting electrode and the emission electrode is smaller that the cleansing force brought about by rapping. Naturally, the residual charge in the particulate matter can be dependent on the length of time between application of the second voltage and the rapping operation.

The reducing of the voltage applied between the collecting electrode and the emission electrode can be carried out during occurrence of the spark, immediately after cessation thereof or shortly after cessation thereof. For example, the reducing of the voltage can be carried out within 10 ms of the onset of the spark, within 5 ms of the onset of the spark or within 2 ms of the onset of the spark. Similarly, the reducing of the voltage can be carried out within 10 ms of cessation of the spark, within 5 ms of cessation of the spark or within 2 ms of cessation of the spark. Carrying out the voltage reduction simultaneous or in close temporal proximity to the spark allows the voltage reduction to reinforce both the aforementioned breakdown of the electric field between the collecting electrode and the emission electrode and the corresponding discharging of the accumulated particulate matter.

The method may comprise mechanically rapping the collecting electrode. As stated above, rapping is a proven technique for removing particulate matter from a collecting electrode of an electrostatic precipitator. The other teachings of the present disclosure easily synergize with conventional rapping techniques to achieve unexpectedly swift and thorough cleansing of the collecting electrode.

The rapping may be carried out during and/or subsequent to the reducing of the voltage applied between the collecting electrode and the emission electrode. The rapping may be carried out while a reduced voltage, e.g. the aforementioned second voltage, is still being applied between the collecting electrode and the emission electrode. Carrying out the rapping during and/or subsequent to the voltage reduction ensures that the rapping is done at a time when the accumulated particulate matter is significantly discharged, thus effecting more thorough cleansing of the collecting electrode.

The method may comprise increasing the voltage applied between the collecting electrode and the emission electrode until the spark between the collecting electrode and the emission electrode occurs.

It is often desirable to cleanse the collecting electrode in accordance with a predetermined schedule. For example, in electrostatic precipitators comprising multiple precipitator sub-units (so-called "fields"), it can be advantageous to cleanse the individual sub-units in a round-robin fashion in which only one of the multiple sub-units is operated at a reduced voltage at a time so that the remaining sub-units can remain operative for removing particulate matter from the gaseous stream.

Since unintentional sparking between the collecting electrode and the emission electrode can reduce the efficiency with which the electrostatic precipitator removes particulate matter from the gaseous stream, it is generally desirable to apply a voltage between the collecting electrode and the emission electrode that is low enough to inhibit uncontrolled sparking between the collecting electrode and the emission electrode.

To ensure that cleansing of the collecting electrode can be carried out in accordance with the desired schedule, it can be useful to actively provoke occurrence of a spark between the collecting electrode and the emission electrode, e.g. by increasing the voltage applied between the collecting electrode and the emission electrode until such a spark occurs.

The reducing of the voltage applied between the collecting electrode and the emission electrode can be carried out in any fashion, e.g. as known to the person skilled in the art. For example, the voltage reduction can be achieved by separating at least one of the collecting electrode and the emission electrode from a power supply used to supply power for applying a voltage between the collecting electrode and the emission electrode, short-circuiting the collecting electrode and the emission electrode, e.g. by means of a short-circuiting circuit, grounding at least one of the collecting electrode and the emission electrode, e.g. by means of a grounding circuit, and/or applying a substantially zero voltage between the collecting electrode and the emission electrode, e.g. by sending an zero-voltage control signal to a power supply applying a voltage between the collecting electrode and the emission electrode.

Although the teachings of the present disclosure have been described above in the context of a method, the teachings are equally applicable to a corresponding apparatus or system.

In an embodiment, the present invention provides a system for cleansing an electrostatic precipitator having a collecting electrode and an emission electrode, the system comprising a voltage reduction controller configured and adapted to reduce a voltage applied between the collecting electrode and the emission electrode upon occurrence of a spark between the collecting electrode and the emission electrode.

As discussed above, a spark between the collecting electrode and the emission electrode intrinsically equates to a significant transfer of charge between the collecting electrode and the emission electrode. The disclosed reduction of an applied voltage upon occurrence of a spark actively reinforces the breakdown of the electric field between the collecting electrode and the emission electrode that is onset by the spark. As a result, the inherent charge in the accumulated particulate matter can be disbanded more swiftly, and cleansing of the collecting electrode can be effected more swiftly and thoroughly, even using conventional cleansing techniques such as rapping.

The system may comprise a spark detector configured and adapted to detect occurrence of a spark between the collecting electrode and the emission electrode. The voltage reduction controller may be configured and adapted to reduce the voltage applied between the collecting electrode and the emission electrode when the spark detector detects occurrence of the spark. For example, the voltage reduction controller may reduce the applied voltage in response to spark detection signal from the spark detector. The spark detector may detect the spark by monitoring a current flowing to the collecting electrode and the emission electrode and/or a voltage between the collecting electrode and the emission electrode. The spark detector may output a spark detection signal in response to an abrupt increase in the current/an abrupt decrease in the voltage.

Here it is important to note the nomenclatural distinction between the voltage (inherently present) between the collecting electrode and the emission electrode and the voltage (actively) applied between the collecting electrode and the emission electrode.

When a spark occurs, the flow of charge between the collecting electrode and the emission electrode will inherently lead to a drop in voltage therebetween unless a supply of charge to the collecting electrode and the emission electrode can compensate for the sudden flow in charge. As touched upon above, this passive drop in voltage can be indicative of occurrence of a spark.

Although the aforementioned supply of charge may strive to maintain a particular voltage, i.e. a particular applied voltage, between the collecting electrode and the emission electrode, this voltage may nonetheless sag to due the inherent imperfection of all real systems, i.e. due to its aforementioned inability to compensate the sudden flow of charge. In the nomenclature of the present disclosure, such a sag in voltage due to inherent imperfections is not to be considered a(n active) reduction of the applied voltage. What is important here is the applied voltage that the (imperfect) system is striving to apply, e.g. in response to a voltage control signal. In other words, a crux of the present disclosure may be seen in actively reducing the voltage applied between the collecting electrode and the emission electrode or reducing the voltage applied between the collecting electrode and the emission electrode in response to a corresponding voltage reduction control signal.

The voltage reduction controller may be configured and adapted to reduce the voltage between the collecting electrode and the emission electrode from a first voltage to a second voltage, as described supra in the context of a method.

The voltage reduction controller may be configured and adapted to begin the reducing (of the voltage applied between the collecting electrode and the emission electrode) during the occurrence of the spark, within 10 ms of an onset of the spark, within 5 ms of an onset of the spark or within 2 ms of an onset of the spark. Similarly, the voltage reduction controller may be configured and adapted to full complete the reducing within the aforementioned timeframes.

For the reasons discussed supra with regard to the method, the system may comprise a rapping mechanism for rapping the collecting electrode. Moreover, the system may comprise a rapping controller configured and adapted to effect rapping by means of the rapping mechanism subsequent to and/or during the reducing (of the voltage applied between the collecting electrode and the emission electrode). The rapping controller configured and adapted to effect the rapping while the reduced voltage, e.g. the aforementioned second voltage, is still being applied between the collecting electrode and the emission electrode. In other words, the rapping controller may send corresponding signals to the rapping mechanism to effect the described rapping.

For the reasons discussed supra with regard to the method, the system may comprise a spark controller configured and adapted to increase the voltage applied between the collecting electrode and the emission electrode until a spark between the collecting electrode and the emission electrode occurs.

For reducing the voltage applied between the collecting electrode and the emission electrode, the system may comprise at least one of a circuit interrupter configured and adapted to separate at least one of the collecting electrode and the emission electrode from a power supply used to supply power for applying a voltage between the collecting electrode and the emission electrode, a short-circuiting system configured and adapted to short-circuit the collecting electrode and the emission electrode, a grounding system configured and adapted to ground at least one of the collecting electrode and the emission electrode, and a voltage supply system configured and adapted to apply a substantially zero voltage between the collecting electrode and the emission electrode, e.g. in response to a zero-voltage control signal.

FIG. 1 shows an embodiment of a system 100 for discharging an electrostatic precipitator 10 in accordance with the present disclosure, e.g. as described hereinabove.

As illustrated in FIG. 1, electrostatic precipitator 10 comprises an inlet 2 for a gaseous stream 4 that contains particulate matter, e.g. fly ash, and an outlet 6 for a gaseous stream 8 from which most of the particulate matter has been removed. Gaseous stream 4 may be a flue gas, for example, from a furnace in which coal is combusted. Electrostatic precipitator 10 has a housing 9 in which a plurality of precipitator subunits, so-called fields 40A, 40B and 40C, are provided, each of fields 40A, 40B and 40C being capable of removing particulate matter from a gaseous stream passing therethrough when in operation. Typically, a large number of fields are used.

Each of fields 40A, 40B and 40C comprises at least one collecting electrode 42, at least one emission electrode 44 and a controllable power supply 46 for applying a voltage between collecting electrode 42 and emission electrode 44. As such, controllable power supply 46 may be configured and adapted to apply a desired charge to either or both of collecting electrode 42 and emission electrode 44 to vary the strength and, in some cases, the polarity of the electric field between collecting electrode 42 and emission electrode 44. The voltage/charge applied by controllable power supply 46 may be stipulated by an input signal 47 received by controllable power supply 46.

Collecting electrode 42 may be of any shape. Collecting electrode 42 may have a large surface for collecting particulate matter and may, for example, have a plate-like shape. In the case of a plurality of collecting electrodes 42, the various collecting electrodes 42 may all have the same shape or be of any combination of same or differing shapes.

Emission electrode 44 may be of any shape. Emission electrode 44 may have a shape that intensifies the electric field strength in the vicinity of emission electrode 44 or a portion thereof for the sake of improving the efficiency with which electrostatic charge can be conveyed onto particulate matter in a gaseous stream. For example, emission electrode 44 may be in the shape of a wire or have one or more spikes. In the case of a plurality of emission electrodes 44, the various emission electrodes 44 may all have the same shape or be of any combination of same or differing shapes.

Although fields 40A, 40B and 40C are shown as having individual power supplies 46, it is likewise feasible to provide a common circuit for supplying power to each of fields 40A, 40B and 40C, e.g. in a manner in which the power supplied to one or more individual fields 40 can be independently controlled.

For each of fields 40A, 40B and 40C, electrostatic precipitator 10 may comprise corresponding rapping mechanisms 50 as well as corresponding hoppers 60. The rapping mechanisms 50 may comprise one or more hammers 56, 58 for rapping the respective collecting electrodes 42 to remove particulate matter that has accumulated thereon. The hoppers 60 are positioned so as to collect the particulate matter that has been rapped from the collecting electrodes 42. A transport mechanism may be provided to automatically transport the particulate matter collected in the hoppers 60 away for appropriate disposal.

As illustrated in FIG. 1, system 100 comprises a spark detector 20 for detecting occurrence of a spark between collecting electrode 42 and emission electrode 44, e.g. by monitoring for abrupt changes in a current and/or voltage between collecting electrode 42 and emission electrode 44.

System 100 moreover comprises a controller 30 that may be configured to receive a spark detection signal from spark detector 20 via a signal line 21. Controller 30 may be a general utility controller having a plurality of sub-units designed to carry out various independent functions. Naturally, these sub-units may be implemented in the form of separate controllers.

Controller 30 may comprise a voltage reduction controller sub-unit that communicates via a signal line 47 with controllable power supply 46 of field 40C, the voltage reduction controller sub-unit being configured to instruct controllable power supply 46 to reduce the voltage applied between collecting electrode 42 and emission electrode 44 in response to receipt of a spark detection signal, as described above, from spark detector 20. The timing and magnitude of such a voltage reduction is discussed supra.

For the sake of reducing the voltage applied between collecting electrode 42 and emission electrode 44, controllable power supply 46 may comprise a circuit interrupter for selectively separating at least one of collecting electrode 42 and emission electrode 44 from a source of electrical power or from all sources of electrical power. Similarly, controllable power supply 46 may comprise a short-circuiting system for selectively establishing a short-circuit between collecting electrode 42 and emission electrode 44. Likewise, controllable power supply 46 may comprise a grounding system for selectively grounding at least one of collecting electrode 42 and emission electrode 44. Furthermore, controllable power supply 46 may be configured and adapted to selectively apply a zero voltage between collecting electrode 42 and emission electrode 44. Any of these selective operations may be carried out, for example, in response to a corresponding signal received via signal line 47 from controller 30 or, more specifically, from the aforementioned voltage reduction controller sub-unit thereof. Naturally, one or more of the circuit interrupter, the short-circuiting system and the grounding system may be implemented separately from controllable power supply 46 and may communicate via one or more separate signal lines with controller 30 or one or more sub-units thereof.

Controller 30 may comprise a rapping controller sub-unit that communicates with one or more of the rapping mechanisms 50 via a signal line 31, the rapping controller sub-unit being configured to induce operation of the individual rapping mechanisms 50 in accordance with a predetermined rapping schedule. For example, the individual fields 40A, 40B and 40C, that is to say the collecting electrodes 42 thereof, may be subjected to a rapping operation in a round-robin manner. In other words, while the collecting electrodes 42 of one field 40A, 40B or 40C are being subjected to a rapping operation, all other fields 40A, 40B, 40C are in operation removing particulate matter from a gaseous stream passing therethrough. Naturally, particularly when there is a large number of fields 40A, 40B, 40C, more than one field may undergo a rapping operation at a given time.

To ensure that rapping may be carried out while a reduced voltage is being applied between collecting electrode 42 and emission electrode 44 as described above, controller 30 may comprise a spark controller sub-unit that communicates via a signal line 47 with controllable power supply 46 of field 40C, the spark controller sub-unit being configured to instruct controllable power supply 46 to increase the voltage applied between collecting electrode 42 and emission electrode 44. The spark controller sub-unit may be configured to terminate this instructing of the controllable power supply 46 in response to receipt of a spark detection signal from spark detector 20. The voltage applied between the collecting electrode 42 and the emission electrode 44 is thus only increased until a spark occurs between these two electrodes.

Although controller 30 is only shown and described as communicating with elements of field 40C, controller 30 or sub-units thereof may equally interact with any of the other fields 40A, 40B of electrostatic precipitator 10. Similarly, the other fields 40A, 40B of electrostatic precipitator 10 may interact with other controllers or sub-units having analogous functionality.

Controller 30 may be implemented using any combination of analog and digital circuitry, e.g. using a correspondingly programmed general purpose microprocessor.

While various embodiments of the present invention have been disclosed and described in detail herein, it will be apparent to those skilled in the art that various changes may be made to the configuration, operation and form of the invention without departing from the spirit and scope thereof. In particular, it is noted that the respective features of the invention, even those disclosed solely in combination with other features of the invention, may be combined in any configuration excepting those readily apparent to the person skilled in the art as nonsensical. Likewise, use of the singular and plural is solely for the sake of illustration and is not to be interpreted as limiting.

LIST OF REFERENCE SIGNS

2 inlet
4 gaseous stream
6 outlet
8 gaseous stream
9 housing
10 electrostatic precipitator
20 spark detector
21 signal line
30 controller
31 signal line
40A,B,C field (precipitator sub-unit)
42 collecting electrode
44 emission electrode
46 controllable power supply
47 signal line
50 rapping mechanism
56 hammer
58 hammer
60 hopper
100 system

What is claimed is:

1. A method for cleansing an electrostatic precipitator having a collecting electrode and an emission electrode, the method comprising:

applying a voltage between the collecting electrode and the emission electrode so that the voltage is at a first voltage level between the collecting electrode and the emission electrode immediately prior to the occurrence of the spark; and reducing the voltage from the first voltage level to a second voltage level upon an occurrence of a spark between the collecting electrode and the emission electrode, with the second voltage level being less than one tenth of the first voltage level.

2. The method of claim 1, wherein the second voltage level is less than one hundredth of the first voltage level.

3. The method of claim 1, wherein the second voltage level is zero.

4. The method of claim 1, wherein reducing voltage levels of the voltage is begun during the occurrence of the spark.

5. The method of claim 1, wherein reducing voltage levels of the voltage is begun in a range of within 2 ms to within 10 ms of an onset of the spark.

6. The method of claim 1, further comprising mechanically rapping the collecting electrode subsequent to the step of reducing the voltage from the first voltage level, and while the second voltage level is still being applied between the collecting electrode and the emission electrode.

7. The method of claim 1, further comprising increasing the voltage from the second voltage level between the collecting electrode and the emission electrode until the spark between the collecting electrode and the emission electrode occurs.

8. The method of claim 1, wherein the step of reducing the voltage from the first voltage level includes at least one of:

separating at least one of the collecting electrode and the emission electrode from a power supply;

short-circuiting the collecting electrode and the emission electrode;

grounding at least one of the collecting electrode and the emission electrode; and applying a substantially zero voltage between the collecting electrode and the emission electrode.

9. The method of claim 1, wherein the first voltage level and the second voltage level are of opposite polarity.

10. A system for cleansing an electrostatic precipitator having a collecting electrode and an emission electrode, the system comprising:

a spark detector configured to detect occurrence of a spark between the collecting electrode and the emission electrode; and a voltage reduction controller configured to reduce a voltage between the collecting electrode and the emission electrode from a first voltage level to a second voltage level when the spark detector detects occurrence of the spark so that the first voltage level is the voltage between the collecting electrode and the emission electrode immediately prior to the occurrence of the spark, and upon occurrence of the spark, the voltage reduction controller reduces the voltage from the first voltage level to the second voltage level with the second voltage level being less than one tenth of the first voltage level.

11. The system of claim 10, wherein the voltage reduction controller reduces the voltage to the second voltage level being less than one hundredth of the first voltage level.

12. The system of claim 10, wherein the voltage reduction controller reduces the voltage to the second voltage level of zero.

13. The system of claim 10, wherein the voltage reduction controller is configured to begin reducing voltage levels of the voltage during the occurrence of the spark.

14. The system of claim 10, wherein the voltage reduction controller is configured to begin reducing voltage levels of the voltage in a range of within 2 ms to within 10 ms of an onset of the spark.

15. The system of claim 10, further comprising a rapping mechanism configured for rapping the collecting electrode and a rapping controller configured to effect the rapping by the rapping mechanism subsequent to the reduction of the voltage between the collecting electrode and the emission electrode, and while the second voltage level of the voltage is between the collecting electrode and the emission electrode.

16. The system of claim 10, further comprising a spark controller configured to increase voltage levels of the voltage between the collecting electrode and the emission electrode until the spark between the collecting electrode and the emission electrode occurs.

17. The system of claim 10, further comprising at least one of:

a circuit interrupter configured to separate at least one of the collecting electrode and the emission electrode from a power supply;

a short-circuiting system configured to short-circuit the collecting electrode and the emission electrode;

a grounding system configured to ground at least one of the collecting electrode and the emission electrode; and a voltage supply system configured to supply the voltage at the second voltage level of substantially zero between the collecting electrode and the emission electrode.

18. The system of claim 10, wherein the first voltage level and the second voltage level are of opposite polarity.

* * * * *